US011380300B2

(12) United States Patent
Joseph et al.

(10) Patent No.: US 11,380,300 B2
(45) Date of Patent: Jul. 5, 2022

(54) AUTOMATICALLY GENERATING SPEECH MARKUP LANGUAGE TAGS FOR TEXT

(71) Applicant: Samsung Electronics Company, Ltd., Suwon-si (KR)

(72) Inventors: Vinod Cherian Joseph, Fremont, CA (US); Varun Nambikrishnan, Palo Alto, CA (US)

(73) Assignee: SAMSUNG ELECTRONICS COMPANY, LTD., Gyeonggi-do (KR)

( * ) Notice: Subject to any disclaimer, the term of this patent is extended or adjusted under 35 U.S.C. 154(b) by 1 day.

(21) Appl. No.: 16/777,360

(22) Filed: Jan. 30, 2020

(65) Prior Publication Data

US 2021/0110811 A1 Apr. 15, 2021

Related U.S. Application Data

(60) Provisional application No. 62/914,137, filed on Oct. 11, 2019.

(51) Int. Cl.
*G10L 13/10* (2013.01)
*G10L 13/033* (2013.01)
*G10L 13/047* (2013.01)

(52) U.S. Cl.
CPC ..... *G10L 13/10* (2013.01); *G10L 13/0335* (2013.01); *G10L 13/047* (2013.01)

(58) Field of Classification Search
CPC ..... G10L 13/10; G10L 13/335; G10L 13/047
USPC ..... 704/259
See application file for complete search history.

(56) References Cited

U.S. PATENT DOCUMENTS 6,510,413 B1 1/2003 Walker
10,276,149 B1 4/2019 Liang
10,319,365 B1 * 6/2019 Nicolis ..... G10L 15/26
10,699,695 B1 * 6/2020 Nadolski ..... G10L 13/047
(Continued)

FOREIGN PATENT DOCUMENTS

KR 10-2012-0117041 A 10/2012
KR 10-2017-0017545 A 2/2017
(Continued)

OTHER PUBLICATIONS

H. Jia and Y. Qi, "A SVOR based method for automatic scoring of prosody quality in Mandarin speech," 2010 International Conference on Machine Learning and Cybernetics, 2010, pp. 2109-2114, doi: 10.1109/ICMLC.2010.5580495. (Year: 2010).*
(Continued)

*Primary Examiner* — Bharatkumar S Shah

(57) ABSTRACT

In particular embodiments, an apparatus comprises a non-transitory computer-readable storage media and a processor coupled to the media executes instructions to: access a plurality of text, generate, using one or more natural language understanding (NLU) models, one or more scores for at least a portion of the plurality of text. The apparatus determines, based on the scores, one or more prosodic values corresponding to the portion of the plurality of text. The apparatus determines, based on the one or more prosodic values, one or more speech synthesis markup language (SSML) tags. The apparatus then generates, based on the prosodic values, SSML-tagged data comprising each determined SSML tag and that tag's location in the plurality of text.

20 Claims, 8 Drawing Sheets

(56) References Cited

U.S. PATENT DOCUMENTS

| | | | | |
|---|---|---|---|---|
| 2005/0060155 | A1* | 3/2005 | Chu | G10L 13/00 704/E19.002 |
| 2007/0055527 | A1 | 3/2007 | Jeong | |
| 2017/0134782 | A1 | 5/2017 | Yamane | |
| 2019/0013017 | A1* | 1/2019 | Kang | G06F 40/35 |
| 2019/0362704 | A1 | 11/2019 | Nicolis | |
| 2020/0279553 | A1* | 9/2020 | McDuff | G10L 15/22 |
| 2021/0073255 | A1* | 3/2021 | Trillo Vargas | G06N 20/00 |

FOREIGN PATENT DOCUMENTS

| | | | |
|---|---|---|---|
| KR | 10-2019-0021409 | A | 3/2019 |
| KR | 10-2019-0096305 | A | 8/2019 |
| KR | 10-2019-0104941 | A | 9/2019 |
| KR | 2020-0015418 | A | 2/2020 |

OTHER PUBLICATIONS

H. Jia and Y. Qi, "A SVOR based method for automatic scoring of prosody quality in Mandarin speech," 2010 International Conference on Machine Learning and Cybernetics, 2010, pp. 2109-2114, doi: 10.1109/ICMLC.2010.5580495. (Year: 2010) (Year: 2010).*

M. A. M. Shaikh, A. R. F. Rebordao, K. Hirose and M. Ishizuka, "Emotional speech synthesis by sensing affective information from text," 2009 3rd International Conference on Affective Computing and Intelligent Interaction and Workshops, 2009, pp. 1-6, doi: 10.1109/ACII.2009.5349515. (Year: 2009).*

H. Jia and Y. Qi, "A SVOR based method for automatic scoring of prosody quality in Mandarin speech," 2010 International Conference on Machine Learning and Cybernetics, 2010, pp. 2109-2114, doi: 10.1109/ICMLC.2010.5580495. (Year: 2010) (Year: 2010) (Year: 2010).*

Azraq, Ahmed et al., "Enhancing the IBM Power Systems Platform with IBM Watson Services," Redbooks, ibm.com/redbooks, SG24-8419-00, Apr. 2018, 218 pages, Apr. 2018.

International Search Report and Written Opinion for International Application No. PCT/KR2020/013621, dated Jan. 5, 2021.

* cited by examiner

AUTOMATICALLY GENERATING SPEECH MARKUP LANGUAGE TAGS FOR TEXT

PRIORITY CLAIM

This application claims the benefit under 35 U.S.C. § 119 of provisional patent application No. 62/914,137 filed on 11 Oct. 2019, which is incorporated herein by reference.

TECHNICAL FIELD

This disclosure generally relates to electronic speech synthesis.

BACKGROUND

Speech synthesis is the artificial production of human speech. A computer system used for this purpose is called a speech computer or speech synthesizer, and can be implemented by software or hardware. Synthesized speech can be created by concatenating pieces of recorded speech that are stored in a database. Text-to-speech (TTS) concerns transforming textual data into audio data that is synthesized to resemble human speech.

DESCRIPTION OF EXAMPLE EMBODIMENTS

Figure 1:
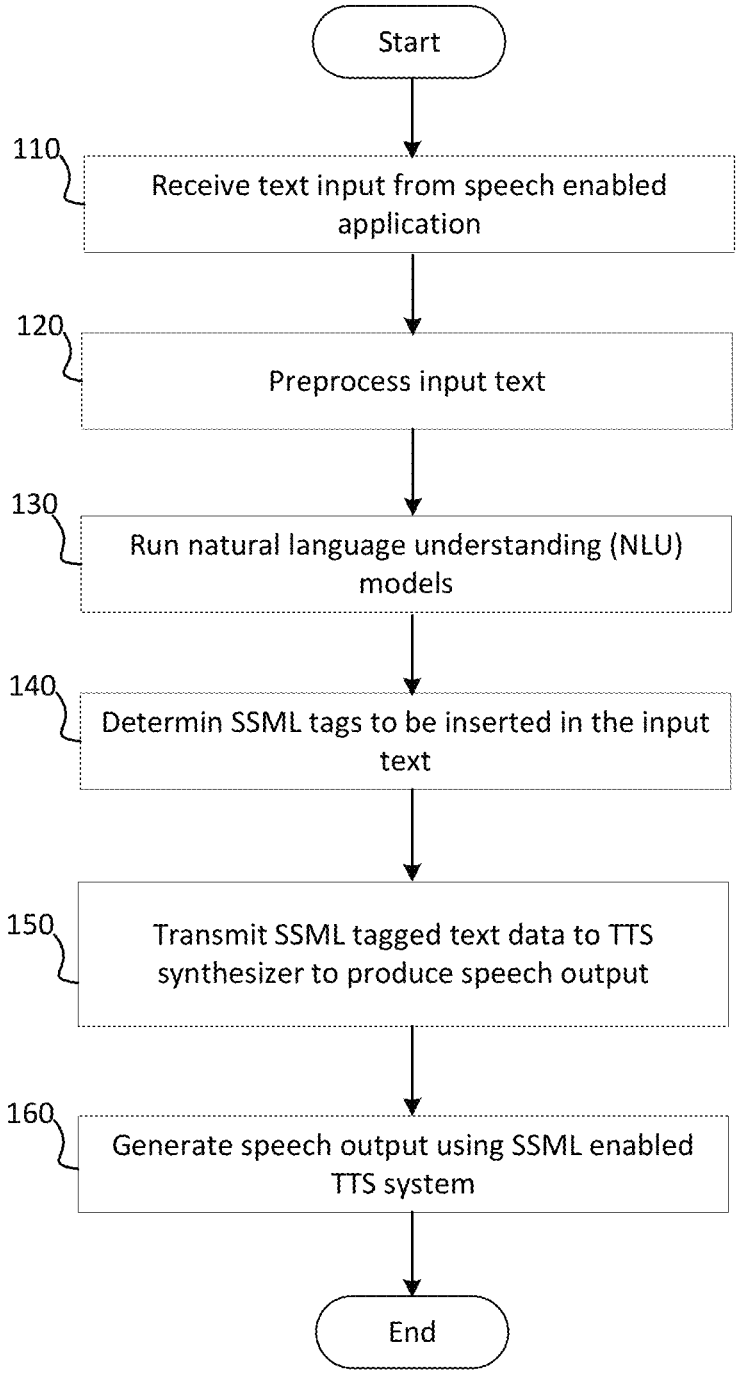
FIG. 1 illustrates an example process for speech synthesis in an SSML-enabled TTS system.

As used herein, a Text-to-Speech (TTS) synthesis means the process of converting text into spoken words. TTS synthesis systems may be integrated into, for example, a virtual assistant for a smartphone or smartspeaker. At times, TTS engines use deep-learning models that train on several hours of recorded voice data in order to learn how to synthesize speech. These deep-learning models (e.g., WaveNet, Tacotron, Deep Voice, etc.) can simulate the human voice. For example, when a TTS system (or engine) receives text, the TTS system performs text analysis, linguistic analysis, and wave form generation, through which the TTS system outputs speech corresponding to the text. In particular embodiments, a TTS system may perform several tasks, such as but not limited to converting raw text containing symbols, such as numbers and abbreviations, into the equivalent of written-out words; assigning phonetic transcriptions to each word; dividing and marking the text into units, such as phrases, clauses, and sentences; and converting the symbolic linguistic representation into sound.

Speech synthesis markup language (SSML) indicates an extensible markup language (XML)-based markup language for speech synthesis applications. In particular embodiments, SSML works by placing text to be spoken between designated opening and closing tags. For example, SSML-enhanced speech may be placed between <speak> and </speak> tags. SSML includes tags that allow for expressive control over aspects of speech including pitch, rate, volume, pronunciation, language, and others. For example, a string of SSML text for increasing the volume of certain portions of text relative to other portions may be:<speak> I<emphasis> really like </emphasis> going to the beach. </speak>. As another example, a string of SSML text for controlling the tone of a particular set of text may be:<speak><prosody rate="90%" pitch="−10%"> It was a sad day for Yankees fans as they lost the game by 10 runs. </prosody></speak>. As described more fully herein, this disclosure contemplates any suitable SSML tags.

As used herein, "sentiment analysis model" indicates a natural language processing model that, given a piece of text, assigns a sentiment value to that piece of text. In particular embodiments, the sentiment may be a classification ("positive"/"negative"/"neutral") or a score, such as, for example, between −1 (most negative) to 1 (most positive)). As described more fully herein, a piece of text may be a word, a phrase, a sentence, a paragraph, a chapter or section, or an entire document. As described more fully herein, a sentiment may be assigned to more than one portion of a piece of text. For example, a word in a particular sentence and the sentence itself may each have a distinct, assigned sentiment value. This disclosure contemplates any suitable model for performing sentiment analysis, such as models that use word embeddings, TF-IDF scores, and machine learning and deep learning architectures. Sentiment intensity can also be measured by these sentiment analysis models.

As used herein, the term TF-IDF stands for term frequency-inverse document frequency, which is a numerical statistic that reflects how important a word is in a document in relation to a corpus/collection of text. For example, in particular embodiments a word will have a high TF-IDF score if it appears many times in a particular document (high term frequency) but not often across a collection of documents (low document frequency). A TF-IDF model may be trained on a large collection of documents (e.g. a large collection of news articles) to accurately estimate TF-IDF scores. In particular embodiments, TF-IDF scores can be summed over sentences to rank sentences.

As used herein, the term "TextRank Model" refers to the TextRank model that may be used to find important passages in an article and/or to identify important sentences in a passage. TextRank generally requires longer passages of text to work properly.

The term "NER model" stands for named entity recognition (NER) Model, which identifies named entities (such as proper nouns) within a passage. Certain NER models, like many natural-language processing tasks, use deep learning to identify named entities within passages.

TTS synthesis often sounds robotic and monotonic, which may decrease user interest in and engagement with the text being synthesized. SSML tags provide fine-tuned control for the expression of speech synthesis, for example by controlling pitch, rate, volume, phonation, and other aspects of speech. Manual curation of SSML tags is currently the only supported approach, however, and manual curation is unworkable and impractical for the vast majority of TTS synthesis, for example because manually inserting SSML tags may be prohibitively expensive for all but the smallest datasets.

Particular embodiments discussed herein describe systems, apparatuses, and methods for automatically generating speech synthesis markup language (SSML) tags, such as SSML tags, for text. As described more fully herein, in particular embodiments a plurality of text may be accessed based on a user input received at a client computing device. One or more natural language understanding (NLU) models may be used to generate one or more scores for at least a portion of the plurality of text. Based on the generated scores, one or more prosodic values corresponding to the portion of the plurality of text may be determined. One or more SSML tags may be determined based on the one or more prosodic values. SSML-tagged data, which includes each determined SSML tag and that tag's location in the plurality of text, may be determined.

FIG. 1 illustrates an example process for speech synthesis in an SSML-enabled TTS system according to embodiments disclosed herein. In Step 110, an SSML-enabled TTS system receives text (such as news articles, short text messages, transcribed voicemails, webpages, emails, etc.) from a user or a service provider. This disclosure contemplates that receiving text may include accessing text that, for example, has been identified by a user, such as by downloading the text to a client device or indicating an address on a network, such as the World Wide Web, at which the text is located. In Step 120, the TTS system preprocess the text, for example by parsing syntax in the received text. At Step 130, the TTS system runs natural-language processing on the preprocessed text, for example to identify parts of speech such as nouns, verbs, etc. At Step 140, the TTS system generates SSML tags and determines where to insert SSML tags in text data. At Step 150, the TTS system passes SSML tagged text to a TTS synthesizer in order to produce audio output corresponding to the SSML-marked text, for example by using a speaker on a user's mobile device. At Step 160, the TTS system generates audible speech output according to the SSML-marked text.

Figure 2:
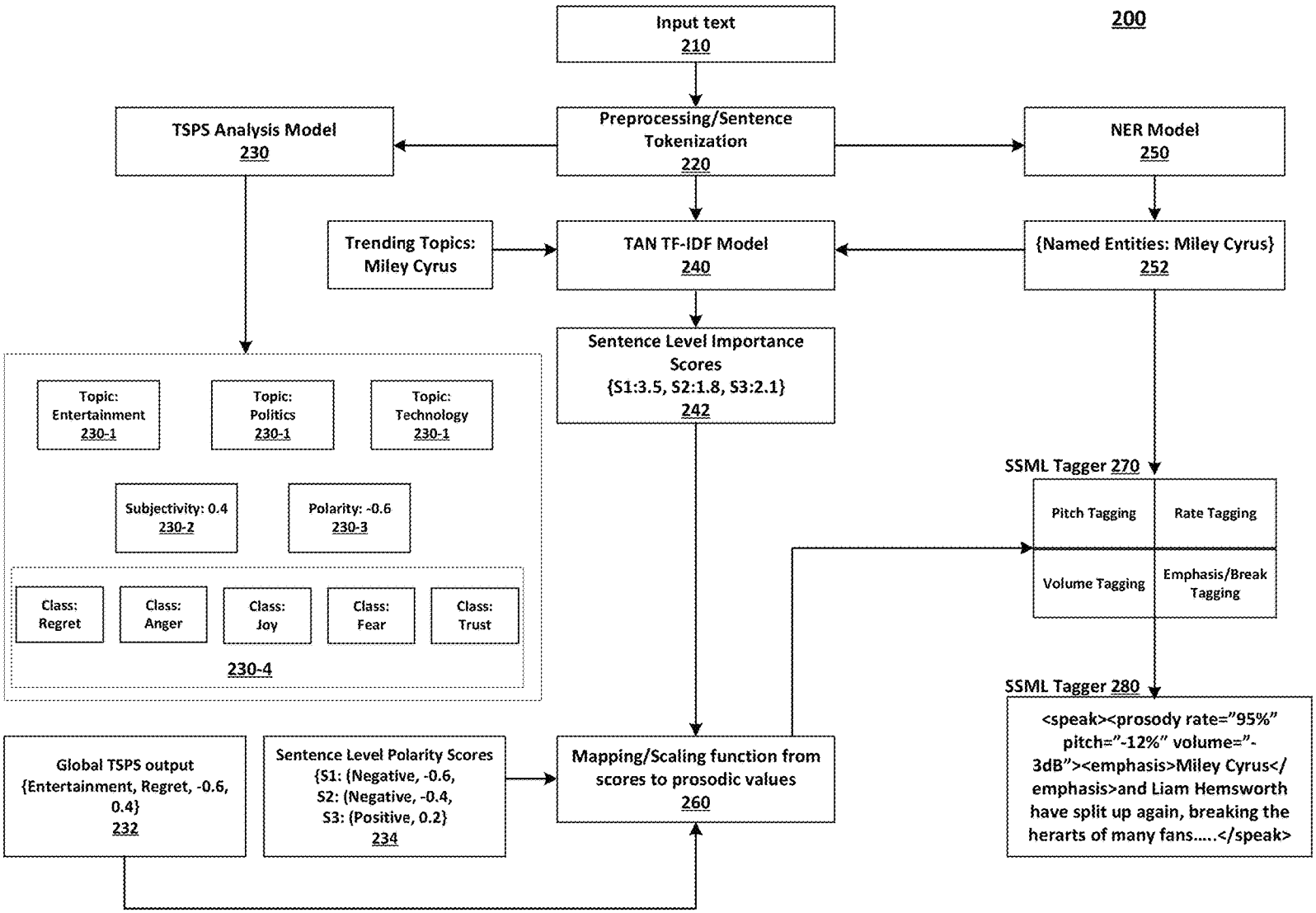
FIG. 2 illustrates an example block diagram for automatically generating SSML tags in an SSML-enabled TTS system.

FIG. 2 illustrates an example block diagram 200 for automatically generating SSML tags in an SSML-enabled TTS system, for example as shown in Step 140 of FIG. 1. FIG. 2 illustrates how to convert raw text into SSML output. In FIG. 2, an SSML-enabled TTS system accesses input text 210, for example by receiving an identification of text from a user. As shown in FIG. 2 for the purposes of illustrating the block diagram, a string of input text may include "Miley Cyrus and Liam Hemsworth have split up again, breaking the hearts of many fans . . . " The SSML-enabled TTS system may then perform preprocessing and/or sentence tokenization 220 on input text. For example, in particular embodiments, the input text is first preprocessed, removing punctuation and other syntactical marks. The input text may also be split into sentences by a sentence tokenizer. This disclosure contemplates other tokenization, such as by phrases, paragraphs, or other units, for use with the procedures set forth in FIG. 2. As shown in FIG. 2, preprocessed and tokenized input text is sent to one or more natural language understanding (NLU) models, for example TSPS ((Topic Sentiment Polarity Subjectivity) analysis model 230, TAN TF-IDF model 240, and named entity recognition (NER) model 250.

In particular embodiments, TSPS analysis model 230 is configured to process the input text to generate global TSPS output (232) and sentence level polarity scores (234). For example, TSPS analysis model 230 may process the input text to obtain the topic of the input text, the text's sentiment class, and polarity and subjectivity scores for the input text. FIG. 2 illustrates particular examples of a topic of the input text (230-1), subjectivity of the input text (230-2), polarity of the input text (230-3), and sentiment class of the input text (230-4). For example, the topic of the input text may be classified according to any suitable pre-defined categories, such as, for example, entertainment, politics, technology, business, sports, technology, etc. At 230-1, TSPS analysis model 230 may process the input text to determine that the topic of input text is classified as a category of "entertainment." In particular embodiments, an SSML-enabled TTS system may use a text-classification model pretrained on categories of text, such as news articles, to obtain the topic of the input text.

In particular embodiments, for other outputs (e.g., subjectivity, polarity, sentiment class) the system 200 may use one or more sentiment analysis models to assign the input text values for each of those three outputs. The sentiment class score may be associated with a variety of pre-defined emotions such as regret, anger, fear, etc. The polarity score identifies the intensity of the sentiment, and in particular embodiments may be a normalized score ranging from −1 to 1. The subjectivity score is an indicator of how objective (e.g., factual) or subjective the text is, and for example may range from 0 (if the text is fully objective) to 1 (if the text is fully subjective).

In FIG. 2, TSPS analysis model 230 processes the input text 210 to determine the analysis results of the input text, which in particular embodiments may include global TSPS output 232 and sentence level polarity scores 234. Global TSPS output 232 identifies the topic of the input text (e.g., entertainment), a sentiment class (e.g., regret), a polarity score (e.g., −0.6) and a subjectivity score (e.g., 0.4). TSPS analysis model 230 may produce sentence level sentiments and corresponding polarity scores 234 for each sentence of the input text. For example, as shown in FIG. 2, S1: (Negative, −0.6); S2: (Negative, −0.4); S3: (Positive, 0.2)). Herein, S1 indicates a first sentence of the input text 210, S2 indicates a second sentence of the input text 210, and S3 indicates a third sentence of the input text 210.

While FIG. 2 describes an example TSPS analysis model that performs sentence-level analysis, such as sentence-level sentiments and polarity scores, this disclosure contemplates a TSPS analysis model that performs such analysis on any suitable unit or combinations of units. For example, sentiments and polarity scores for a given text could be performed on both paragraphs and sentences of that text.

In the example of FIG. 2, TAN TF-IDF model 240 processes the input text to identify and classify named entities (e.g., "Miley Cyrus" in the input text 210) from passages or sentences of the input text. In particular embodiments, TAN (Trending Adaptive NER boosted) TF-IDF model 240 is a sublinear pivot-normalized variant of a standard TF-IDF model. In particular embodiments, TAN TF-IDF model 240 may be trained on a large corpus of articles to get accurate frequencies for word or phrase usage. TAN TF-IDF model 240 may use logarithmic term scaling (sublinear), as well as pivot normalization, to prevent bias against longer documents. In order to weight words or phrases in an input text, TAN TF-IDF model 240 may maintain a list of trending topic words from any suitable database of documents, such as news source or social media. TAN TF-IDF model 240 may analyze the input text and, if a term is one of those topic words, TAN TF-IDF model 240 may increase the TF-IDF score for the current unit of text, which in the example of FIG. 2 is a sentence but may be any suitable unit.

In particular embodiments TAN TF-IDF model 240 maintains an adaptive model of term importance such that TAN TF-IDF model 240 updates its database for each input text provided. In particular embodiments, TAN TF-IDF model 240 may increase a TF-IDF score for a particular unit of language, such as a sentence, depending on where in the sentence the trending word or phrase appears. For example, an importance score may increase if the trending word or phrase starts the sentence, is a direct object of the sentence, is the subject of the sentence, or ends the sentence. As shown in FIG. 2, TSPS analysis model 240 ultimately produces sentence-level importance score for each sentence of the input text 210 (e.g., S1: 3.5; S2: 1.8; S3: 2.1). Herein, S1 indicates the first sentence of the input text 210, S2 indicates the second sentence of the input text 210, and S3 indicates the third sentence of the input text 210. However, as with TSPS model 230, this disclosure contemplates scoring any suitable unit or units of input text using TAN TF-IDF model 240.

As illustrated in FIG. 2, NER model 250 receives input text, identifies named entities in the input text, and classifies the named entities with a particular tag (e.g., person, event, geographical entity, geopolitical entity, organization, time, etc.). NER model 250 outputs a mapping from named entities in the input text to the type of named entity. For example, an output of NER model 250 may be: {France: geographical entity, Obama: person}. As shown in FIG. 2, these mappings may be passed to the SSML Tagger to determine whether or not to modify elements of the input text, such as by emphasizing some or all of the named entities. Such emphasis may be applied according to predefined rules, such as emphasizing the first named entity in a sentence, the first full name present, etc. The mappings may also be passed to TAN TF-IDF model 240, which may take the entity-tag mappings and determine whether to increase importance scores based on those mappings.

As shown in FIG. 2, the SSML-enabled TTS system includes a mapping/scaling function 260 that takes the scores processed by models 230, 240 and 250 and determines prosodic values corresponding to a portion of the input text 210. For example, in the example of FIG. 2, mapping/scaling function 260 generates prosodic values based on the global polarity and subjectivity scores, the sentence-level polarity scores, and the sentence level importance scores. In the example of FIG. 2, the prosodic values determined by mapping/scaling function 260 are pitch, rate, volume, and emphasis, but this disclosure contemplates using any suitable prosodic values to automatically tag SSML text. As shown in FIG. 2, in particular embodiments the SSML-enabled TTS system may send the prosodic values to an SSML tagger 270. The SSML tagger 270 generates, using the prosodic values determined by mapping/scaling function 260, particular SSML tags to be added into the portions of the input text. In particular embodiments, SSML tagger 270 also takes as input the mapping of named entities and tags from NER model 250 and adds appropriate opening and closing tags for each sentence, as well as the required <speak>, </speak> tags around the entire passage of the input text. As shown in element 280, the SSML tagger generates SSML-tagged data (e.g., the input text interspersed with the SSML tags and values determined by the example of FIG. 2) by adding SSML tags generated by the SSML tagger 270.

While the example of FIG. 2 illustrates using each of NLU models 230, 240, and 250 to automatically select and place particular SSML tags, this disclosure contemplates that particular embodiments may use fewer than all three NLU models to automatically select and place particular SSML tags, while other embodiments may use additional NLU models to automatically select and place particular SSML tags.

In particular embodiments, the example of FIG. 2 automatically adds SSML tags to text without needing to train on SSML-tagged text. In particular embodiments, the example of FIG. 2 provides use of pivot normalized sublinear TAN (Trending Adaptive NER boosted) TF-IDF model (trained on a set of training texts) to identify the most important passages and/or sentences of a text, such as a news summary (or an article), and vary inflection between the most important passages and the rest of the text. In particular embodiments, the example of FIG. 2 generates unique mapping/interpolation functions that are able to take in sentiment/importance scores and produce prosodic values for the SSML pitch, rate, and volume tags. Moreover, in particular embodiments, the example of FIG. 2 may be used to create an initial SSML-tagged dataset that can be used to train other models for more expressive TTS synthesis.

Figure 3:
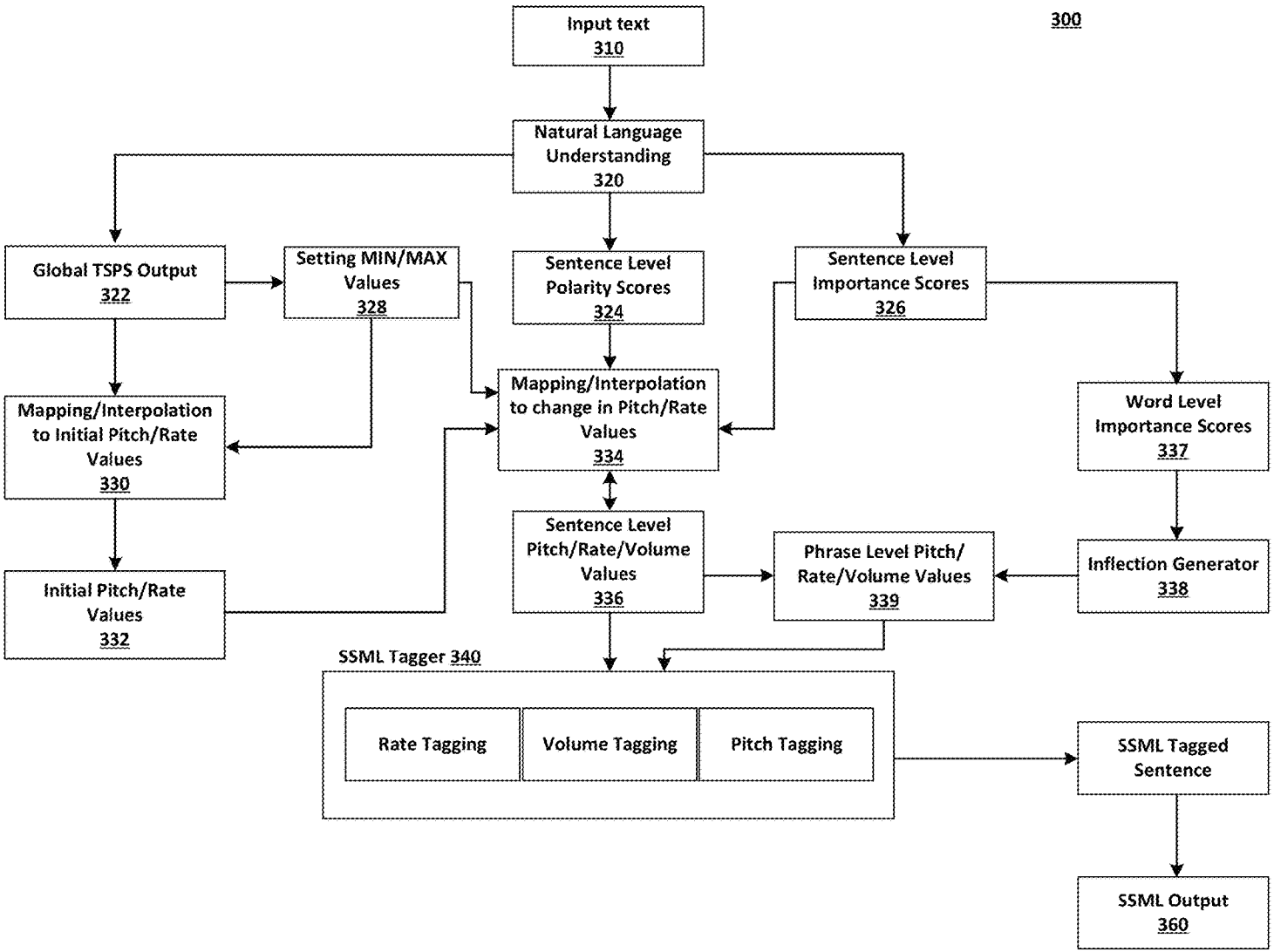
FIG. 3 illustrates an example block diagram for automatically generating SSML tags in an SSML-enabled TTS system.

FIG. 3 illustrates an example block diagram for automatically generating SSML tags in an SSML-enabled TTS system. As explained in connection with FIG. 2, an SSML-enabled TTS system preprocesses input text 310, and using appropriate NLU models 320 (e.g., models 230, 240 and 250 in FIG. 2) the system processes the input text 310 to generate (1) a global polarity score of global TSPS output 322 of the input text 310, (2) sentence-level polarity scores 324, and (3) sentence-level importance scores 326 for each sentence of the input text 310.

As shown in FIG. 3, the SSML-enabled TTS system may set initial MIN/MAX values 328 for both pitch and rate prosody values in order to map and interpolate the global TSPS output to initial pitch/rate values 332. For example, the SSML-enabled TTS system may constrain how much the initial MIN/MAX 328 values can be changed based on the subjectivity scores of global TSPS output 322, where more subjective sentences in the input text 310 (i.e., sentences with higher subjectivity score) are generally more emotionally charged and therefore have more variation in MIN/MAX rate and pitch values. As another example, the SSML-enabled TTS system may adjust the initial MIN/MAX values based on how the base TTS synthesizer sounds without SSML.

In particular embodiments, a SSML-enabled TTS system may pass (or transfer) a global polarity score to a mapping and interpolation function 330 that maps the range of global polarity (intensity values) to the range of values between the preset min/max values for both pitch and rate so that a baseline value (e.g., initial pitch/rate values 332) for a passage of the input text 310 is determined. A SSML-enabled TTS system may then pass these initial baseline values as parameter to the sentence-level interpolation function 334, which also receives the sentence-level polarity scores and the sentence-level importance scores, and the system 300 then may output a change in pitch/rate/volume from the previous sentences. The sentence-level interpolation function 334 may then use these inputs to determine prosody value, such as pitch, rate, and volume, for each sentence of the input text. As explained in connection with FIG. 2 above, while this example describes sentence-level scoring and prosody values, this disclosure contemplates such scoring and value determination on any suitable unit of text.

In particular embodiments, a SSML-enabled TTS system may impose a maximum change in prosody values, such as pitch and rate, that is allowed between sentences to keep synthesized speech from making drastic changes in such prosody values between sentences. The sentence-level mapping and interpolation function 334 may map each sentence's TF-IDF score to a change in pitch/rate from an initial value or the previous sentence's value. In particular embodiments, a SSML-enabled TTS system may first determine global min/avg/max sentence-level prosody scores for all sentences of the input text 320. In addition or the alternative, a SSML-enabled TTS system may provide variation between passages by computing the min/avg/max sentence-level prosody scores within a passage of the input text 310 and varying these min/avg/max sentence-level values between passages. In particular embodiments, if the sentence-level sentiment score of global TSPS output 322 is above the global polarity score (e.g., by a set threshold value), a SSML-enabled TTS system may increase or decrease the pitch/rate/volume values 336 in proportion to how much higher or lower the sentence-level sentiment score is than the global score.

As shown in FIG. 3, a SSML-enabled TTS system may pass pitch/rate/volume values 336 computed for each sentence of the input text 310 both to SSML tagger 340 as well as back to the sentence level mapping interpolation function 334 as a parameter(s) for a next sentence of the input text 310. The SSML tagger 340 adds, into corresponding portions of the input text 310, appropriate pitch, volume and rate tags with values specified (or generated) by the mapping interpolation function. A SSML-enabled TTS system may set, as "medium," a volume for each sentence of the input text 310 if the volume is not the maximum TF-IDF score (or the top n scores in a longer passage, where n can be a number or percentage). Otherwise, if the global sentiment intensity is greater than 0 (e.g., if the global sentiment intensity is positive), the volume can be set to "loud" and if the global sentiment intensity is less than zero (negative) then the volume can be set to "soft." Setting a level of the volume therefore, in particular embodiments, emphasizes the most important sentence(s) in the input text 310. The system 300 may adjust the level of the volume for each sentence or for the top (i.e., high scoring) n sentences. SSML Tagger 340 adds appropriate volume tags to each sentence. The system 300 then generates SSML tagged sentences 350 and renders SSML tagged sentences (or passages or phrases) as SSML output (e.g., SSML-tagged data) 360.

While the example of FIG. 3 describes pitch, rate, and volume prosody values, this disclosure contemplates using the example of FIG. 3 to determine and vary the value of any suitable prosody values. In addition, while the example of FIG. 3 describes sentences as the basic unit of input text, this disclosure contemplates using the procedure of FIG. 3 on any suitable units, such as phrases or paragraphs.

In particular embodiments, a SSML-enabled TTS system may determine word (or phrase) level importance to generate word-level importance scores 337 for each word of sentences of the input text 310. For example, particular embodiments may use an inflection generator 338 to add word-or-phrase-level SSML tagging through upward, downward, and circumflex inflections. The inflection generator 338 may preset a change in word-level pitch (or word-level rate/volume values, or all of them) 339 required for these inflections (e.g., by setting constants for DOWN, UP, CIRC, as described more fully below) and then set rules for adding these inflections. The inflection generator 338 may add downward/circumflex inflection to the most important n words in each sentence or each paragraph of the input text 310 to draw particular attention to the important words, and soften the preceding k words to emphasize these inflections, where k is equal to or greater than n. In particular embodiments, inflection generator 338 may also add downward inflections to the end of the most important sentences or paragraphs of the input text 310. In particular embodiments, the inflection generator 338 may add upward inflections to sentences that end with a question mark or exclamation point. The inflection generator 338 may add, for purposes of variation, upward inflections in between two downward inflections, and such inflection may be weighted by the importance of the downward inflections. In particular embodiments, a SSML-enabled TTS system may mark inflection words in each sentence of the input text 310, and then the SSML tagger 340 may add appropriate pitch tags in addition to the sentence-level tagging.

Figure 4:
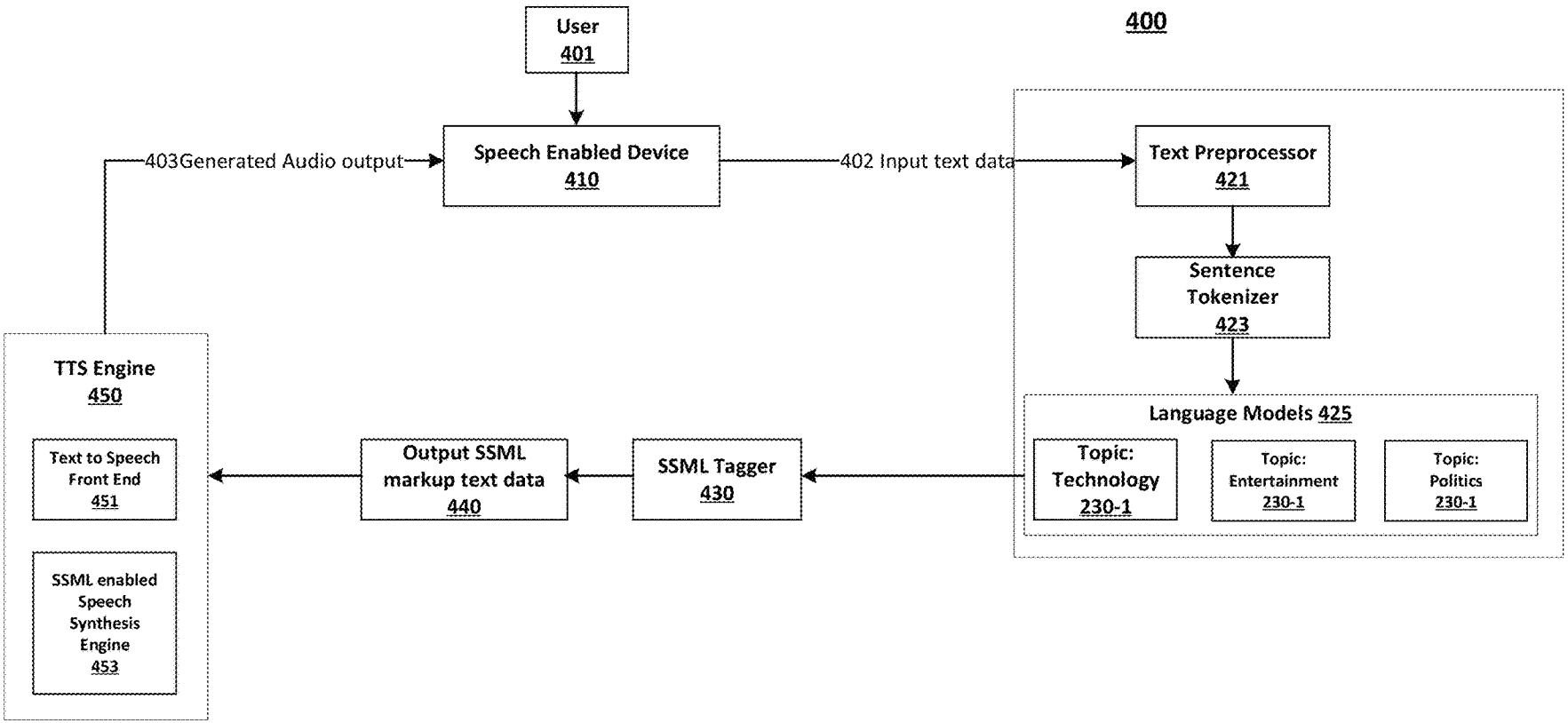
FIG. 4 illustrates an example block diagram of an SSML tagger operating in a SSML enabled TTS system.

FIG. 4 illustrates an example block diagram of an SSML tagger operating in a SSML enabled TTS system. In particular embodiments, FIG. 4 specifies how SSML tagger 430 of the SSML-enabled TTS system 400 operates within the larger system. For example, when a user 401 identifies text to be converted to audio, speech-enabled device 410 receives input text data 402 through an application installed in the device 410. As explained herein, a user may identify text by selecting text, inputting text, or requesting that particular text or particular content (such as a particular website article) be synthesized to speech.

As shown in FIG. 4, device 410 may send input text 402 to NLU models 425, which may be executed on device 410 or on a connected device, such a server device accessible by device 410, or both. In particular embodiments, text preprocessor 421 preprocess the input text 402, and uses sentence tokenizer 423 to divide the input text into sentences. The system 400 then runs NLU models 425 on the preprocessed and tokenized input text to generate prosodic values to be inserted by the SSML tagger 430 into portions of the input text. The system 400 then transfers these values to the SSML tagger 430 to insert appropriate tags to the input text, where the tags include, but are not limited to, pitch, rate, volume, and emphasis tags. SSML tagger 430 may be executed on device 410 or on a connected device, such a server device accessible by device 410, or both.

SSML tagger 430 outputs SSML-tagged data 440, and transfers that data to TTS engine 450. TTS engine 450 includes speech front-end 451 configured to receive the SSML-markup text data 440 and a speech back-end (not shown) containing an SSML-enabled TTS engine 453. The SSML-enabled TTS engine 453 is configured to convert the SSML-markup text data 440 to speech output and generate audio output 403 corresponding to the input text 402. The audio output 403 (i.e., speech output converted from the input text data 402) is sent back to the speech-enabled device 410 such that the device 410 outputs the generated audio back to the user 401. This disclosure contemplates that TTS engine 450 may be executed on device 410 or on a connected device, such a server device accessible by device 410, or both.

Figure 5:
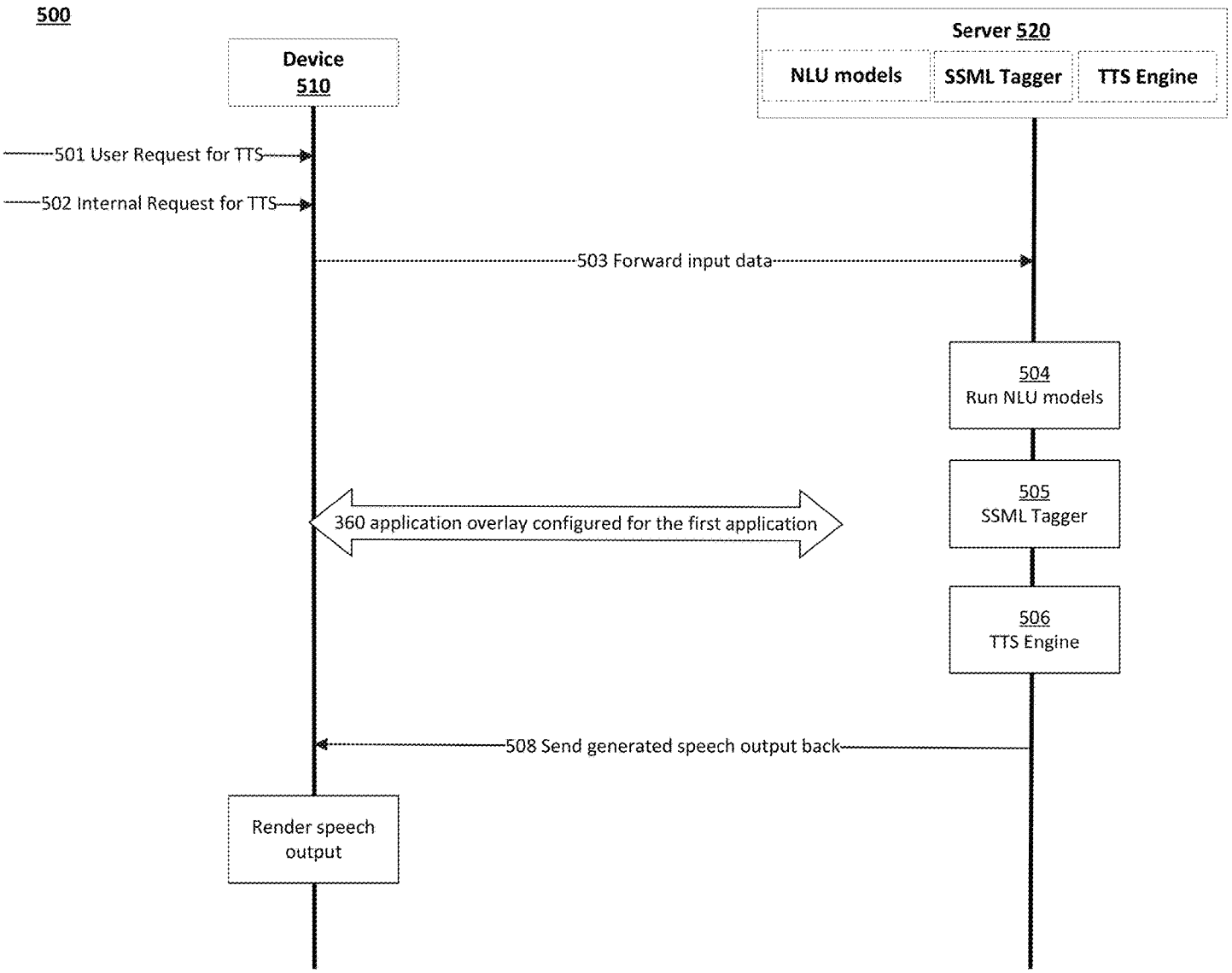
FIG. 5 illustrates an example block diagram of an architecture for SSML tagging in an SSML-enabled TTS system.

FIG. 5 illustrates an example block diagram of an architecture for SSML tagging in an SSML-enabled TTS system. The SSML-enabled TTS system 500 in FIG. 5 may comprise speech-enabled device 510 configured to send input data (e.g., news summaries, article/document, response to user query (QA system)) for TTS request, and server 520 configured to generate SSML-tagged data in response to the request. The server 520 may execute NLU models 504, SSML tagger 505 and TTS engine 506. In particular embodiments, some or all of NLU models 504, SSML tagger 505 and TTS engine 506 may be embodied within the device 510.

The device 510 receives either the request for input data directly from a user or indirectly (such as when the user uses an application that uses TTS) at Steps 501 and 502. The input data requested for TTS may include at least one portion of text (e.g., news summaries, articles, documents, etc.) as well as QA responses from a virtual assistant (e.g. BIXBY, SIRI, CORTANA, ALEXA, GOOLGE ASSISTANT etc.). The device 510 sends the input data to the server 520 at Step 503. The server 520 preprocess the input data and tokenizes the preprocessed input data into sentences. At Step 507, the server 520 generates speech output for the input data by converting the input data to SSML-tagged audio data using NLU models 504, SSML tagger 505 and TTS engine 506. In particular embodiments, the server 520 then runs the NLU models 504 on the input data to generate prosodic values to be inserted by the SSML tagger 505 into portions of the input data received by server 520. The server 520 generates (or outputs) SSML markup text data, and transfers the SSML markup text data to TTS engine 506. TTS engine 506 receives the SSML-markup text data and converts the SSML-markup text data to audio data for generating the speech output corresponding to the input data. The server 520 then sends the speech output back to the device 510 to render to the user at Step 508. In particular embodiments, server 520 sends SSML markup text data directly to device 510, which converts that data to audio data to render to the user.

In particular embodiments, the mapping/scaling function 260 of FIG. 2 may be performed by a neural network that receives the inputs identified in connection with FIG. 2 and outputs prosodic values. For example, the neural network may include an encoder, a collaborative attention model, and a decoder that outputs prosodic values, SSML tags, and/or SSML-tagged data, depending on the inputs used. For example, particular embodiments may use a labeled dataset of SSML-tagged data where each instance covers a sequence of input tokens $x^1, \ldots, x^n$ along with the label y. The inputs are passed through the pre-trained model to obtain transformer block's activation v. A collaborative attention model gives the decoder of the neural network access to all the encoder's hidden states, and the baseline information is used to decide which hidden states to use and which to ignore by weighting the hidden states. In particular embodiments, the collaborative attention model uses linear word embeddings with the contextual class of references, including the number of occurrences, in order to concatenate and apply different linear transformations to the values, keys, and queries for each head of the attention, based on context.

Figure 6:
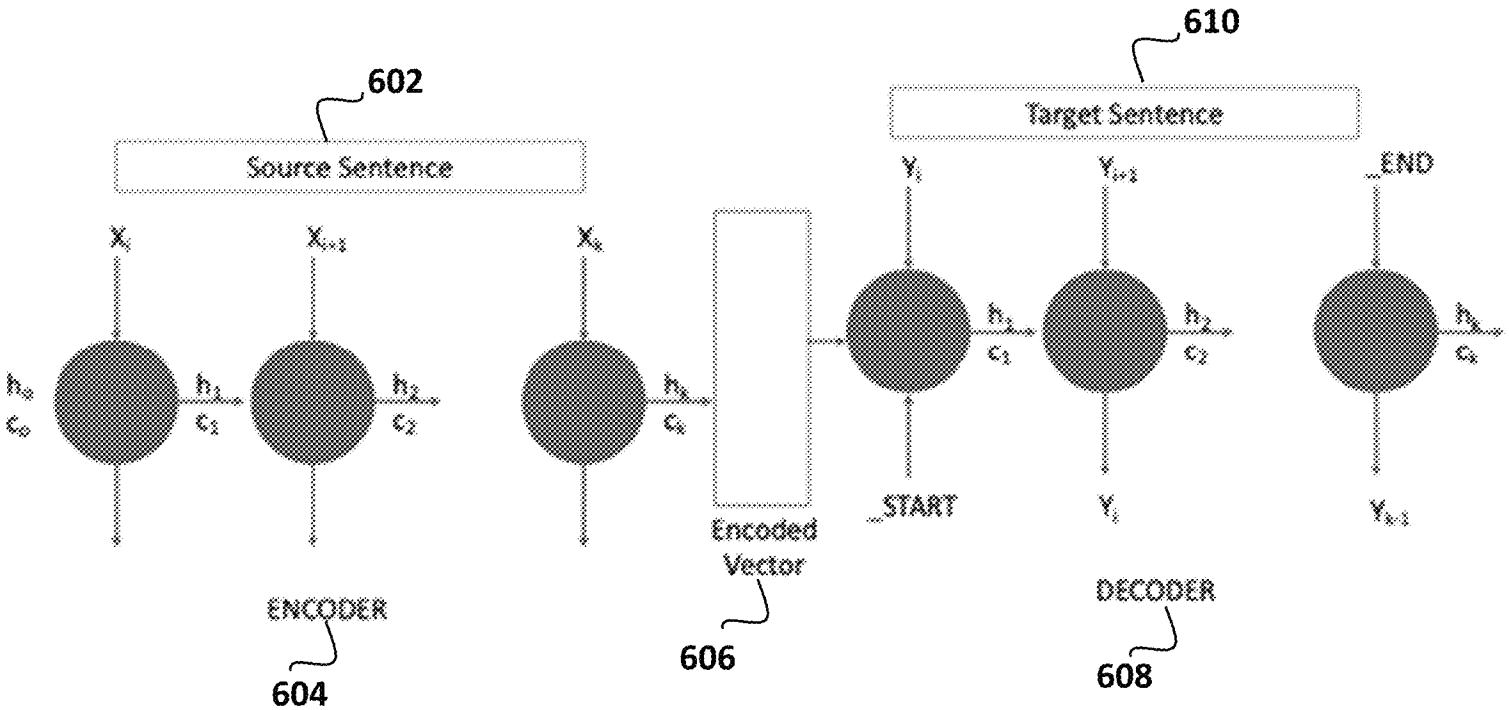
FIG. 6 illustrates an example neural network for tagging text with SSML tags.

FIG. 6 illustrates an example neural network for tagging for tagging text with SSML tags. For example, encoder 604 and decoder 608 of the example neural network described may be part of a sequence-to-sequence (seq2seq) model for neural machine translation. Both encoder 604 and decoder 608 may be recurrent neural networks, such as long short-term memory (LSTM) networks. The seq2seq model may include attention to identify where to place SSML tags within the received input text. For instance, in the example of FIG. 6, input text (such as a source sentence 602) may be fed into encoder 604, which uses seq2seq to predict the hidden states, cell states, and discarded outputs. The output of encoder 604 may be a vector, such as encoded vector 606, that is then passed as input to decoder 608. Based on vector 606 output by encoder 604, decoder 608 predicts where to insert the SSML tags within the input text. In particular embodiments, decoder 608 may then feed its output (which may be tagged input text, such as target sentence 610) to a NER model (such as NER model 250), which determines what weights to apply to the SSML tags based on, e.g., the current popularity of words or phrases within the input text.

Particular embodiments may utilize a rule-based approach for determining prosodic values. This approach may be used in lieu of a neural network, or may be used to circumvent the "cold start" problem associated with neural networks. For example, a TAN TF-IDF model may use pivot normalized sublinear TAN TF-IDF for weighing sentences by importance. For example, a TF-IDF score for a sentence may equal the sum of TF-IDF weights of all terms in the sentence according to the following formula:

$$\sum_{t \in S} (Tr_{mult} + NER_{boost})((1 + \log_2 tf_{t,d}) * idf_t)$$

where tf represents term frequency; idf represents inverse document frequency; $NER_{boost}$ represents an increase in scores for named entities in certain positions of a sentence, as described more fully above; and $Tr_{mult}$ represents a multiplier for strongly trending topics across, e.g., news sources or social media networks. In particular embodiments this formula may be adaptive, such that each scoring instance will update the system's corpus of documents, thereby updating inverse document frequencies for terms as well as frequencies for words and phrases.

As an example of scoring according to a TAN TF-IDF function, suppose some input text is:

> Sen. Kamala Harris wrote on Twitter that her proposed plan would forgive debts for "Pell Grant recipients who start a business that operates for three years in disadvantaged communities". In the 2017-2018 school year, 7 million people received Pell Grants. The announcement came as the latest in student debt forgiveness as a popular talking point for 2020 contenders.

Sentence level TF-IDF Scores may be [3.35, 0.74, 1.25] for each of the three sentences in the input text. Word level TF-IDF Scores (sorted by importance) may be:

> [['kamala harris', 0.76 (Trending)], ['pell grant', 0.66], ['disadvantaged', 0.24], ['debts', 0.23], ['recipients', 0.21], ['forgive', 0.21], ['operates', 0.19], ['communities', 0.12], ['proposed', 0.12], ['sen', 0.11], ['received', 0.1], ['plan', 0.09], ['start', 0.08], ['wrote', 0.08], ['business', 0.07], ['twitter', 0.07], ['three', 0.05], ['years', 0.03]] [['pell grants', 0.55], ['school', 0.08], ['million', 0.07], ['year', 0.04]] [['forgiveness', 0.22], ['contenders', 0.21], ['debt', 0.15], ['announcement', 0.13], ['student', 0.12], ['talking', 0.1], ['popular', 0.1], ['latest', 0.09], ['point', 0.07], ['came', 0.06]]

In this example of TAN TD-IDF scoring, the first sentence is determined to be the most important and 'Kamala Harris' and 'pell grant' are the most important words/phrases, and the importance scores of those words may be boosted given their relative positions in the sentences of the input text, while "Kamala Harris" may also receive an increase in score from trending on news sites.

In particular embodiments, a TF-IDF model may be faster during run time than running text through an RNN-based model or an LSA-based model. A TF-IDF model works on shorter passages and may boost "trending" words, thereby engaging the user with passages that contain the most relevant information. In addition, boosting words based on their location in a sentence mimics human speech and therefore may provide natural-sounding inflection within a passage.

As explained in Step 230 in FIG. 2, a TSPS analysis model generates global TSPS output 232 (e.g., topic, sentiment class score, subjectivity score) and sentence-level polarity scores 234. Below is an example of a TSPS scoring. For example, suppose some input text is the following news summary:

> Rupert Stadler is accused of having developed engines used in Audi, Volkswagen and Porsche branded cars that used emissions cheat devices. Three other defendants are being charged with false certification and criminal advertising practices.

The TSPS model may determine, based on the words and phrases in the summary, that the topic is "business." Such determination may be made based on preset classes using, for example, a logistic regression text classifier. The TSPS model may determine that the sentiment is "anger" using, for example, a multiclass sentiment analysis model. The TSPS model may determine that the global polarity is "−0.23" corresponding to negative sentiment, but not an especially strong sentiment. The TSPS model may determine that subjectivity is "0.1," i.e., that the summary mostly only states facts, without framing bias. The TSPS model may determine that the sentence-level polarity scores are [−0.24, −0.44], as both sentences express somewhat negative sentiment with words like "criminal," "accused," and "false." However, brands such as car brands may generally have a positive sentiment associated with them, which is why the second sentence is classified as more negative than the first.

Particular embodiments may use a topic/sentiment class from the TSPS model to set minimum (MIN) and maximum (MAX) values for pitch/rate/volume. In particular embodiments, these ranges may be preset based on how a person would read a passage, such as news. For example, entertainment may have a wider range of values, while business articles may have less range. Sad news will have a relatively lower pitch, while happier news will have a relatively faster rate.

An SSML-enabled TTS system may generate an initial pitch and rate using global polarity scores and an interpolation function that maps the range of global polarity values (constrained, for example, from −1 to 1) to the range (MIN-MAX) of pitch and rate values. Then, for each sentence, an SSML-enabled TTS system can use an interpolation function to map from TAN TF-IDF scores to a change in pitch/rate, where a higher TF-IDF score maps to an increase in pitch/decrease in rate and a lower TF-IDF score maps to a decrease in pitch and increase in rate. In particular embodiments, the amount of change is determined by the subjectivity score (the more subjective the speech, the greater the variation in pitch/rate). In particular embodiments, if the sentence-level polarity score is greater than or less than the global polarity score (subject, perhaps, to some threshold value) then the SSML-enabled TTS system can additionally increase/decrease pitch and rate by an amount proportional to how much greater the sentiment score is than the global polarity score. In particular embodiments, the volume value of a sentence may be set to "medium" if the TF-IDF value is not the maximum of the passage. Otherwise, for the maximum TF-IDF value in the passage if the global sentiment is positive, the volume is set to "loud," while if the global sentiment is negative then the volume is set to "soft."

In order to map global polarity scores to initial pitch and rate value, an SSML-enabled TTS system may use a numpy interpolation function that takes an integer/array to be mapped, an increasing range of input values, and a range of output values and maps the integer/array to the corresponding output value. For example, np.interp (2.5, [1, 2, 3, 4], [−10, −8, 8, 12])=0. This can be interpreted as numbers in the range 1 and 2 are mapped linearly to the range −10 to −8, and numbers between 2 and 3 are mapped linearly to the range −8 to 8, etc. meaning 2.5 would be mapped to 0. In particular embodiments, this may maximize variation in inflection, as the SSML-enabled TTS system can specify a wider output range for sentiment polarities close to zero. For example, most sentiment polarities fall between the range of −0.1 to 0.2 for news., which makes sense if news is often phrased rather objectively. As another example, an SSML-enabled TTS system may use np.interp(gp, [−0.32, −0.1, 0.0, 0.2, 1.0], [MIN_PITCH, MIN_PITCH+2, 0, MAX_PITCH-2, MAX_PITCH]) and np.interp(gp, [−0.32, −0.1, 0.0, 0.2, 1.0], [MIN_RATE, MIN_RATE+2, 100, MAX_RATE-2, MAX_RATE]).

In order to map from sentence-level importance scores to changes in pitch and rate, an SSML-enabled TTS system may use the interpolation function discussed above. The SSML-enabled TTS system may specify PITCH_VAR and RATE_VAR to be the maximum change in pitch and rate allowed between consecutive sentences. If pitch or rate is varied too much between sentences the speech synthesis will sound unnatural and can even sound like two distinct voices. An SSML-enabled TTS system can determine the range using the subjectivity score, such that the higher the score the larger the range.

One possibility for mapping TF-IDF scores to changes in pitch/rate is to use global fixed interpolation so that all sentences are mapped the same way from the minimum/average/maximum TF-IDF scores in the corpus. For example, this approach may use the following formula: np.interp(tfidf, [GLOB_MIN_TFIDF, GLOB_AVG_TFIDF, GLOB_MAX_TFIDF], [−PITCH/RATE_VAR, 0, PITCH/RATE_VAR). This approach may produce less unnatural sounding passages, with a majority of sentences that have very similar inflection.

A second possibility for mapping TF-IDF scores to changes in pitch/rate is to use maximizing variance interpolation, which sets the input range based on the range of TF-IDF scores in the current passage rather than the corpus. For example, this approach may use the following formula: np.interp(tfidf, [SENT_MIN_TFIDF, SENT_AVG_TFIDF, SENT_MAX_TFIDF], [−PITCH/RATE_VAR, 0, PITCH/RATE_VAR). This approach may produce more variation/expressive speech synthesis compared to the previous example discussed above.

In particular embodiments, the pitch and rate for a particular sentence may equal the previous pitch/rate values plus the pitch/rate values from TAN TF-IDF and the pitch/rate values determined by the sentence-level sentiment.

Particular embodiments of an SSML-enabled TTS system may use an inflection generator, which may enhance fine-grained SSML tagging, such as at the phrase level. Particular embodiments may use three types of inflection. Downward inflection represents a change in pitch from higher to lower within a vowel/end of phrase, and can indicate certainty, power, finality, and confidence. Upward inflection represents a change in pitch from lower to higher within a vowel, and indicates questioning, surprise, and ridicule. Circumflex inflection means downward then upward inflection or upward then downward inflection, which may have a similar effect to downward inflection but adds more variation.

Inflection can be changed by using pitch tags in SSML, such as DOWN, UP, and CIRCUMFLEX to change the pitch on the last/last two vowels of a word. Particular embodiments may add downward/circumflex inflection to the most important n words in a passage to draw special attention to them. Particular embodiments may also soften the previous k words to more strongly emphasize the downward inflection. Particular embodiments may add downward inflections to the end of the most important sentences, for example to emphasize the end of the phrase. Particular embodiments may add inflection using a function that determines where to add upward inflection for variation in the passage. For example, upward inflection may be automatically added to any sentence with a question mark/exclamation point. As another example, upward inflection may be placed at a point between two downward inflections, inversely weighted by the importance of the words with the downward inflections. For example, the upward inflection position may be such that UP_position=DOWN1_pos+(DOWN2_position−DOWN1_position)/2+int(TFIDF1−TFIDF2)

Figure 7:
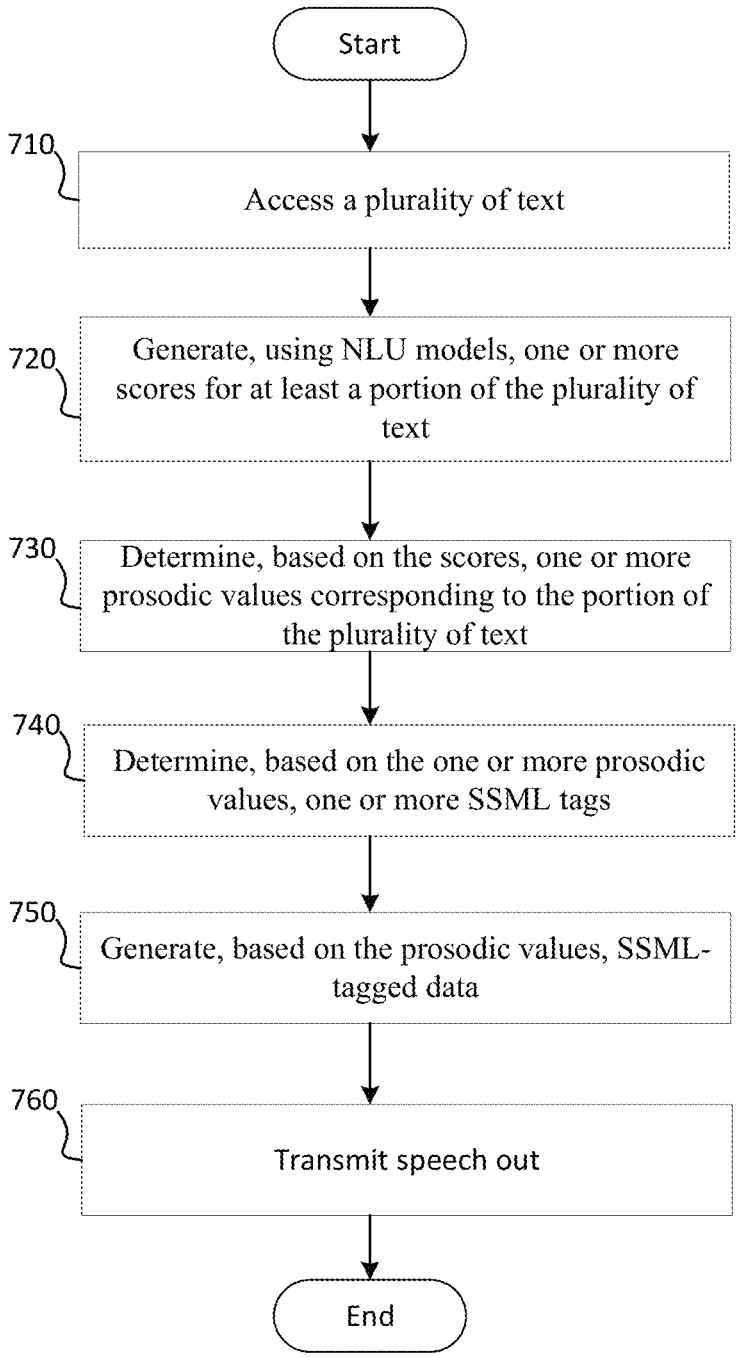
FIG. 7 illustrates another example process for speech synthesis in an SSML-enabled TTS system.

FIG. 7 illustrates another example process for speech synthesis in an SSML-enabled TTS system. In particular embodiments, a plurality of text may be accessed based on a user input received at a client computing device (at Step 710). One or more natural language understanding (NLU) models may be used to generate one or more scores for at least a portion of the plurality of text (at Step 720). Based on the generated scores, one or more prosodic values corresponding to the portion of the plurality of text may be determined (at Step 730). One or more SSML tags may be determined based on the one or more prosodic values (at Step 740). SSML-tagged data, which comprises each determined SSML tag and tag's location in the plurality of text, may be generated (at Step 750). Particular embodiments may output synthesized speech by a speaker of the client computing device, where the speech output comprises the plurality of text verbalized according to the SSML-tagged data (at Step 760).

Figure 8:
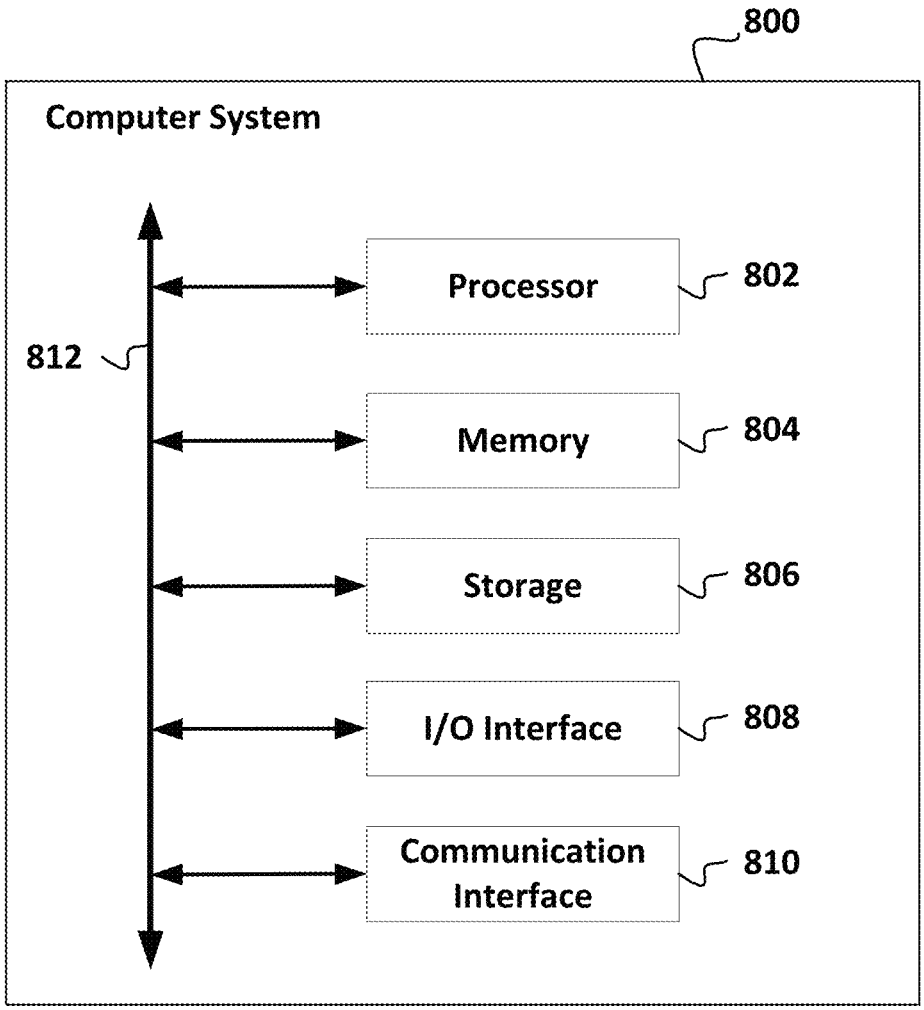
FIG. 8 illustrates an example computer system.

FIG. 8 illustrates an example computer system 800. In particular embodiments, one or more computer systems 800 perform one or more steps of one or more methods described or illustrated herein. In particular embodiments, one or more computer systems 800 provide functionality described or illustrated herein. In particular embodiments, software running on one or more computer systems 800 performs one or more steps of one or more methods described or illustrated herein or provides functionality described or illustrated herein. Particular embodiments include one or more portions of one or more computer systems 800. Herein, reference to a computer system may encompass a computing device, and vice versa, where appropriate. Moreover, reference to a computer system may encompass one or more computer systems, where appropriate.

This disclosure contemplates any suitable number of computer systems 800. This disclosure contemplates computer system 800 taking any suitable physical form. As example and not by way of limitation, computer system 800 may be an embedded computer system, a system-on-chip (SOC), a single-board computer system (SBC) (such as, for example, a computer-on-module (COM) or system-on-module (SOM)), a desktop computer system, a laptop or notebook computer system, an interactive kiosk, a mainframe, a mesh of computer systems, a mobile telephone, a personal digital assistant (PDA), a server, a tablet computer system, an augmented/virtual reality device, or a combination of two or more of these. Where appropriate, computer system 800 may include one or more computer systems 800; be unitary or distributed; span multiple locations; span multiple machines; span multiple data centers; or reside in a cloud, which may include one or more cloud components in one or more networks. Where appropriate, one or more computer systems 800 may perform without substantial spatial or temporal limitation one or more steps of one or more methods described or illustrated herein. As an example and not by way of limitation, one or more computer systems 800 may perform in real time or in batch mode one or more steps of one or more methods described or illustrated herein. One or more computer systems 800 may perform at different times or at different locations one or more steps of one or more methods described or illustrated herein, where appropriate.

In particular embodiments, computer system 800 includes a processor 802, memory 804, storage 806, an input/output (I/O) interface 808, a communication interface 810, and a bus 812. Although this disclosure describes and illustrates a particular computer system having a particular number of particular components in a particular arrangement, this disclosure contemplates any suitable computer system having any suitable number of any suitable components in any suitable arrangement.

In particular embodiments, processor 802 includes hardware for executing instructions, such as those making up a computer program. As an example and not by way of limitation, to execute instructions, processor 802 may retrieve (or fetch) the instructions from an internal register, an internal cache, memory 804, or storage 806; decode and execute them; and then write one or more results to an internal register, an internal cache, memory 804, or storage 806. In particular embodiments, processor 802 may include one or more internal caches for data, instructions, or addresses. This disclosure contemplates processor 802 including any suitable number of any suitable internal caches, where appropriate. As an example and not by way of limitation, processor 802 may include one or more instruction caches, one or more data caches, and one or more translation lookaside buffers (TLBs). Instructions in the instruction caches may be copies of instructions in memory 804 or storage 806, and the instruction caches may speed up retrieval of those instructions by processor 802. Data in the data caches may be copies of data in memory 804 or storage 806 for instructions executing at processor 802 to operate on; the results of previous instructions executed at processor 802 for access by subsequent instructions executing at processor 802 or for writing to memory 804 or storage 806; or other suitable data. The data caches may speed up read or write operations by processor 802. The TLBs may speed up virtual-address translation for processor 802. In particular embodiments, processor 802 may include one or more internal registers for data, instructions, or addresses. This disclosure contemplates processor 802 including any suitable number of any suitable internal registers, where appropriate. Where appropriate, processor 802 may include one or more arithmetic logic units (ALUs); be a multi-core processor; or include one or more processors 802. Although this disclosure describes and illustrates a particular processor, this disclosure contemplates any suitable processor.

In particular embodiments, memory 804 includes main memory for storing instructions for processor 802 to execute or data for processor 802 to operate on. As an example and not by way of limitation, computer system 800 may load instructions from storage 806 or another source (such as, for example, another computer system 800) to memory 804. Processor 802 may then load the instructions from memory 804 to an internal register or internal cache. To execute the instructions, processor 802 may retrieve the instructions from the internal register or internal cache and decode them. During or after execution of the instructions, processor 802 may write one or more results (which may be intermediate or final results) to the internal register or internal cache. Processor 802 may then write one or more of those results to memory 804. In particular embodiments, processor 802 executes only instructions in one or more internal registers or internal caches or in memory 804 (as opposed to storage 806 or elsewhere) and operates only on data in one or more internal registers or internal caches or in memory 804 (as opposed to storage 806 or elsewhere). One or more memory buses (which may each include an address bus and a data bus) may couple processor 802 to memory 804. Bus 812 may include one or more memory buses, as described below. In particular embodiments, one or more memory management units (MMUs) reside between processor 802 and memory 804 and facilitate accesses to memory 804 requested by processor 802. In particular embodiments, memory 804 includes random access memory (RAM). This RAM may be volatile memory, where appropriate. Where appropriate, this RAM may be dynamic RAM (DRAM) or static RAM (SRAM). Moreover, where appropriate, this RAM may be single-ported or multi-ported RAM. This disclosure contemplates any suitable RAM. Memory 804 may include one or more memories 804, where appropriate. Although this disclosure describes and illustrates particular memory, this disclosure contemplates any suitable memory.

In particular embodiments, storage 806 includes mass storage for data or instructions. As an example and not by way of limitation, storage 806 may include a hard disk drive (HDD), a floppy disk drive, flash memory, an optical disc, a magneto-optical disc, magnetic tape, or a Universal Serial Bus (USB) drive or a combination of two or more of these. Storage 806 may include removable or non-removable (or fixed) media, where appropriate. Storage 806 may be internal or external to computer system 800, where appropriate. In particular embodiments, storage 806 is non-volatile, solid-state memory. In particular embodiments, storage 806 includes read-only memory (ROM). Where appropriate, this ROM may be mask-programmed ROM, programmable ROM (PROM), erasable PROM (EPROM), electrically erasable PROM (EEPROM), electrically alterable ROM (EAROM), or flash memory or a combination of two or more of these. This disclosure contemplates mass storage 806 taking any suitable physical form. Storage 806 may include one or more storage control units facilitating communication between processor 802 and storage 806, where appropriate. Where appropriate, storage 806 may include one or more storages 806. Although this disclosure describes and illustrates particular storage, this disclosure contemplates any suitable storage.

In particular embodiments, I/O interface 808 includes hardware, software, or both, providing one or more interfaces for communication between computer system 800 and one or more I/O devices. Computer system 800 may include one or more of these I/O devices, where appropriate. One or more of these I/O devices may enable communication between a person and computer system 800. As an example and not by way of limitation, an I/O device may include a keyboard, keypad, microphone, monitor, mouse, printer, scanner, speaker, still camera, stylus, tablet, touch screen, trackball, video camera, another suitable I/O device or a combination of two or more of these. An I/O device may include one or more sensors. This disclosure contemplates any suitable I/O devices and any suitable I/O interfaces 808 for them. Where appropriate, I/O interface 808 may include one or more device or software drivers enabling processor 802 to drive one or more of these I/O devices. I/O interface 808 may include one or more I/O interfaces 808, where appropriate. Although this disclosure describes and illustrates a particular I/O interface, this disclosure contemplates any suitable I/O interface.

In particular embodiments, communication interface 810 includes hardware, software, or both providing one or more interfaces for communication (such as, for example, packet-based communication) between computer system 800 and one or more other computer systems 800 or one or more networks. As an example and not by way of limitation, communication interface 810 may include a network interface controller (NIC) or network adapter for communicating with an Ethernet or other wire-based network or a wireless NIC (WNIC) or wireless adapter for communicating with a wireless network, such as a WI-FI network. This disclosure contemplates any suitable network and any suitable communication interface 810 for it. As an example and not by way of limitation, computer system 800 may communicate with an ad hoc network, a personal area network (PAN), a local area network (LAN), a wide area network (WAN), a metropolitan area network (MAN), or one or more portions of the Internet or a combination of two or more of these. One or more portions of one or more of these networks may be wired or wireless. As an example, computer system 800 may communicate with a wireless PAN (WPAN) (such as, for example, a BLUETOOTH WPAN), a WI-FI network, a WI-MAX network, a cellular telephone network (such as, for example, a Global System for Mobile Communications (GSM) network), or other suitable wireless network or a combination of two or more of these. Computer system 800 may include any suitable communication interface 810 for any of these networks, where appropriate. Communication interface 810 may include one or more communication interfaces 810, where appropriate. Although this disclosure describes and illustrates a particular communication interface, this disclosure contemplates any suitable communication interface.

In particular embodiments, bus 812 includes hardware, software, or both coupling components of computer system 800 to each other. As an example and not by way of limitation, bus 812 may include an Accelerated Graphics Port (AGP) or other graphics bus, an Enhanced Industry Standard Architecture (EISA) bus, a front-side bus (FSB), a HYPERTRANSPORT (HT) interconnect, an Industry Standard Architecture (ISA) bus, an INFINIBAND interconnect, a low-pin-count (LPC) bus, a memory bus, a Micro Channel Architecture (MCA) bus, a Peripheral Component Interconnect (PCI) bus, a PCI-Express (PCIe) bus, a serial advanced technology attachment (SATA) bus, a Video Electronics Standards Association local (VLB) bus, or another suitable bus or a combination of two or more of these. Bus 812 may include one or more buses 812, where appropriate. Although this disclosure describes and illustrates a particular bus, this disclosure contemplates any suitable bus or interconnect.

Herein, a computer-readable non-transitory storage medium or media may include one or more semiconductor-based or other integrated circuits (ICs) (such, as for example, field-programmable gate arrays (FPGAs) or application-specific ICs (ASICs)), hard disk drives (HDDs), hybrid hard drives (HHDs), optical discs, optical disc drives (ODDs), magneto-optical discs, magneto-optical drives, floppy diskettes, floppy disk drives (FDDs), magnetic tapes, solid-state drives (SSDs), RAM-drives, SECURE DIGITAL cards or drives, any other suitable computer-readable non-transitory storage media, or any suitable combination of two or more of these, where appropriate. A computer-readable non-transitory storage medium may be volatile, non-volatile, or a combination of volatile and non-volatile, where appropriate.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

Herein, "automatically" and its derivatives means "without human intervention," unless expressly indicated otherwise or indicated otherwise by context.

The scope of this disclosure encompasses all changes, substitutions, variations, alterations, and modifications to the example embodiments described or illustrated herein that a person having ordinary skill in the art would comprehend. The scope of this disclosure is not limited to the example embodiments described or illustrated herein. Moreover, although this disclosure describes and illustrates respective embodiments herein as including particular components, elements, feature, functions, operations, or steps, any of these embodiments may include any combination or permutation of any of the components, elements, features, functions, operations, or steps described or illustrated anywhere herein that a person having ordinary skill in the art would comprehend. Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative. Additionally, although this disclosure describes or illustrates particular embodiments as providing particular advantages, particular embodiments may provide none, some, or all of these advantages.

What is claimed is:

1. An apparatus, comprising:

one or more non-transitory computer-readable storage media embodying instructions; and one or more processors coupled to the storage media and configured to execute the instructions to:

access a plurality of text;

generate, using one or more natural language understanding (NLU) models, a sentiment class score indicative of one or more emotions for at least a portion of the plurality of text and a subjectivity score indicative of subjectivity for at least the portion of the plurality of text;

determine, based on the subjectivity score, a rate of change in pitch or rate values for the portion of the plurality of text;

determine, based on the sentiment class score and the subjectivity score, one or more prosodic values corresponding to the portion of the plurality of text;

determine, based on the one or more prosodic values, one or more speech synthesis markup language (SSML) tags corresponding to the one or more emotions indicated by the sentiment class score; and generate, based on the prosodic values, SSML-tagged data comprising the determined one or more SSML tags and respective tag location in the portion of the plurality of text.

2. The apparatus of claim 1, wherein:

the apparatus further comprises a client computing device comprising a speaker; and the one or more processors are further configured to execute the instructions to:

access the plurality of text based on a user input received at the client computing device; and initiate transmission of speech output to the speaker, wherein the speech output comprises the plurality of text with instructions to verbalize the portion of the plurality of text according to the SSML-tagged data.

3. The apparatus of claim 1, wherein:

the apparatus further comprises a server computing device; and the one or more processors are further configured to execute the instructions to:

receive an identification of the portion of the plurality of text based on an input of a user of a client computing device; and transmit the SSML-tagged data to the client computing device.

4. The apparatus of claim 1, wherein:

the prosodic values comprise a pitch value and a rate value; and the one or more processors are further configured to execute the instructions to dynamically set minimum and maximum ranges for the pitch value and the rate value based on the subjectivity score.

5. The apparatus of claim 1, wherein the one or more processors are further configured to execute the instructions to:

identify in the portion of the plurality of text a plurality of sentences and words; and generate a set of scores including one or more of:

the subjectivity score for each sentence of the portion of the plurality of text;

a polarity score for each sentence of the portion of the plurality of text; or an importance score for each sentence or each word of the portion of the plurality of text.

6. The apparatus of claim 1, wherein the one or more NLU models comprise a first NLU model configured to:

categorize the portion of the plurality of text according to a set of topics; and generate a polarity score and the subjectivity score for each sentence of the portion of the plurality of text.

7. The apparatus of claim 6, wherein the one or more NLU models further comprise a second NLU model configured to generate an importance score for each of a plurality of portions of the plurality of text.

8. The apparatus of claim 7, wherein the plurality of portions of the plurality of text comprise one or more of a sentence, a phrase, or a word in the plurality of text.

9. The apparatus of claim 7, wherein the one or more NLU models further comprise a third NLU model configured to identify as a trending topic one or more words or phrases in the portions of the plurality of text.

10. The apparatus of claim 9, wherein the inflection characteristics comprise at least one of: an upward inflection, a downward inflection, or a circumflex inflection.

11. The apparatus of claim 1, wherein the one or more processors are further configured to execute the instructions to:

generate word-level importance scores for words or phrases in the portion of the plurality of text; and determine, based on the word-level importance scores, inflection characteristics for the portion of the plurality of text.

12. The apparatus of claim 1, wherein the one or more prosodic values correspond to one or more of a pitch, a rate of speech, a volume of speech, an amount of emphasis, or a length of a pause.

13. The apparatus of claim 1, wherein to determine the one or more prosodic values based on the sentiment class score, the one or more processors are further configured to execute the instructions to:

provide, to a neural network, the portion of the plurality of text and the sentiment class score from the one or more NLU models; and receive, from the neural network, the one or more prosodic values corresponding to the portion of the plurality of text.

14. One or more non-transitory computer-readable storage media embodying instructions that, when executed by one or more processors, cause the one or more processors to:

access a plurality of text;

generate, using one or more natural language understanding (NLU) models, a sentiment class score indicative of one or more emotions for at least a portion of the plurality of text and a subjectivity score indicative of subjectivity for at least the portion of the plurality of text;

determine, based on the subjectivity score, a rate of change in pitch or rate values for the portion of the plurality of text;

determine, based on the sentiment class score and the subjectivity score, one or more prosodic values corresponding to the portion of the plurality of text;

determine, based on the one or more prosodic values, one or more speech synthesis markup language (SSML) tags corresponding to the one or more emotions indicated by the sentiment class score; and generate, based on the prosodic values, SSML-tagged data comprising the determined one or more SSML tags and respective tag location in the portion of the plurality of text.

15. The non-transitory computer-readable storage media of claim 14, wherein the instructions further comprise instructions to:

access the plurality of text based on a user input received at the client computing device; and initiate transmission of speech output to the speaker, wherein the speech output comprises the plurality of text with instructions to verbalize the portion of the plurality of text according to the SSML-tagged data.

16. A method performed by one or more processors of a computing system, comprising:

accessing a plurality of text;

generating, using one or more natural language understanding (NLU) models a sentiment class score indicative of one or more emotions for at least a portion of the plurality of text and a subjectivity score indicative of subjectivity for at least the portion of the plurality of text;

determine, based on the subjectivity score, a rate of change in pitch or rate values for the portion of the plurality of text;

determining, based on the sentiment class score and the subjectivity score, one or more prosodic values corresponding to the portion of the plurality of text;

determining, based on the one or more prosodic values, one or more speech synthesis markup language (SSML) tags corresponding to the one or more emotions indicated by the sentiment class score; and generating, based on the prosodic values, SSML-tagged data comprising the determined one or more SSML tags and respective tag in the portion of the plurality of text.

17. The method of claim 16, further comprising:

accessing the plurality of text based on a user input received at the client computing device; and initiating transmission of speech output to the speaker, wherein the speech output comprises the plurality of text with instructions to verbalize the portion of the plurality of text according to the SSML-tagged data.

18. The method of claim 16, further comprising:

receiving an identification of the portion of the plurality of text based on an input of a user of a client computing device; and transmitting the SSML-tagged data to the client computing device.

19. The method of claim 16, wherein the prosodic values comprise a pitch value and a rate value, the method further comprising dynamically setting minimum and maximum ranges for the pitch value and the rate value based on the subjectivity score.

20. The method of claim 16, further comprising:

identifying in the portion of the plurality of text a plurality of sentences and words; and generating a set of scores including one or more of:

the subjectivity score for each sentence of the portion of the plurality of text;

a polarity score for each sentence of the portion of the plurality of text; or an importance score for each sentence or each word of the portion of the plurality of text.

* * * * *